US006738684B2

(12) United States Patent
Buchholz et al.

(10) Patent No.: US 6,738,684 B2
(45) Date of Patent: May 18, 2004

(54) METHOD AND APPARATUS FOR CONTROLLING CONVERTING REWINDER LINES

(75) Inventors: William Buchholz, Greenville, WI (US); Walter E. Kelm, Green Bay, WI (US); Kelly L. Pepin, Green Bay, WI (US); Lawrence J. Roskom, Green Bay, WI (US); Jay R. Ryczkowski, Tybee Island, GA (US)

(73) Assignee: Fort James Corporation, Atlanta, GA (US)

( * ) Notice: Subject to any disclaimer, the term of this patent is extended or adjusted under 35 U.S.C. 154(b) by 229 days.

(21) Appl. No.: 10/098,867

(22) Filed: Mar. 13, 2002

(65) Prior Publication Data

US 2002/0193903 A1 Dec. 19, 2002

Related U.S. Application Data

(60) Provisional application No. 60/278,175, filed on Mar. 23, 2001.

(51) Int. Cl.[7] ..... G06F 19/00; B65H 18/14

(52) U.S. Cl. ..... 700/126; 700/122; 242/534; 226/118.1

(58) Field of Search ..... 700/122, 128, 700/126; 162/262; 242/530, 534, 534.21, 544; 226/42, 118.1

(56) References Cited

U.S. PATENT DOCUMENTS

| | | | | |
|---|---|---|---|---|
| 4,328,931 | A | 5/1982 | Bullock, Jr. et al. | 242/67.5 |
| 5,091,032 | A | 2/1992 | Schulz | 156/219 |
| 5,402,350 | A | 3/1995 | Kline | 364/468 |
| 5,904,812 | A | 5/1999 | Salman et al. | 162/117 |
| 6,026,334 | A | 2/2000 | Kayihan et al. | 700/28 |
| 6,050,519 | A | 4/2000 | Biagiotti | 242/526.1 |
| 6,168,679 | B1 | 1/2001 | Biagiotti | 156/64 |

FOREIGN PATENT DOCUMENTS

| | | |
|---|---|---|
| EP | 0 892 096 A2 | 1/1999 |

*Primary Examiner*—Leo Picard
*Assistant Examiner*—Steven R. Garland
(74) *Attorney, Agent, or Firm*—Michael W. Ferrell

(57) ABSTRACT

A method of controlling a converting line having a rewinder, accumulator, and downstream equipment includes: providing upper and lower target limits for the accumulator level; determining the slowest maximum speed of the downstream equipment; determining the fastest minimum speed of the downstream equipment; monitoring the speed of the rewinder and the actual level of the accumulator; generating a master speed reference value to control the downstream equipment which: (i) corresponds to said slowest maximum speed of the downstream equipment if the actual accumulator level is greater than the upper target limit; or (ii) corresponds to the fastest minimum speed of the downstream equipment if the actual accumulator level is less than the lower target limit; or (iii) is based on the actual production speed of the rewinder if the actual accumulator level is less than the upper target limit and greater than the lower target limit for the accumulator.

21 Claims, 4 Drawing Sheets

METHOD AND APPARATUS FOR CONTROLLING CONVERTING REWINDER LINES

CLAIM FOR PRIORITY

This non-provisional application claims the benefit of the filing date of U.S. Provisional Patent Application Serial No. 60/278,175, of the same title, filed Mar. 23, 2001.

TECHNICAL FIELD

The present invention relates generally to converting lines wherein a parent roll of towel or tissue stock is rewound and cut to rolls suitable for distribution. More particularly, the invention relates to a method and apparatus for controlling the production of such converting production lines.

BACKGROUND ART

Rewinders and converting lines are known in the art. Typically converting lines including one or more rewinders also include a log accumulator, one or more logsaws, one or more wrappers and one or more casepackers with associated tail sealers, convergers, diverters, conveyers and like equipment. Typically a converting operation for tissue or towel to form rolls suitable for consumption will include rewinding a parent roll of material into smaller "logs" of diameter suitable for distribution; cutting the logs into suitable roll lengths; wrapping the rolls and packing them into cases for shipment. During rewinding, the material may be embossed or printed if so desired. The machinery included as well as the various steps involved are relatively complex, requiring sophisticated control.

There is disclosed, for example, in U.S. Pat. No. 6,168,679 to Biagiotti a method of controlling a rewinding operation by way of monitoring the diameter of a roll by correlating the angular velocity of the roll with the linear speed of the web. The information thus obtained may be used for determining when to glue the tail to the rewound log or to start a new log.

In U.S. Pat. No. 6,050,519 also to Biagiotti there is disclosed a method of converting web material based on the idea of combining the winding and gluing of the free tail edge of the log in a single section of the processing line, eliminating the accumulator as well as a station for unwinding and positioning the free tail edge of the log. The object of such a layout is to minimize the size of the converting line as well as simplify control thereof.

In U.S. Pat. No. 4,328,931 to Bullock et al. there is disclosed a method of controlling the web speed of a converting rewinder based on the status of equipment in the system.

It should further be noted that during a converting operation, the web may be calendered or embossed or both as noted in U.S. Pat. No. 5,904,812 to Salman et al. or as described in U.S. Pat. No. 5,091,032 to Schulz. The disclosure of the foregoing patents is incorporated herein by reference.

SUMMARY OF INVENTION

The present invention provides a way of balancing material flow, minimizing undesirable starts/stops and generally increasing the efficiency of a converting operation through an integrated control methodology and architecture. There is provided in accordance with the present invention a method of controlling a converting line provided with a rewinder, an accumulator and equipment downstream from the accumulator, including the steps of: (a) providing an upper target limit for the inventory level of the accumulator; (b) providing a lower target limit for the inventory level of the accumulator; (c) determining the slowest maximum speed of the downstream equipment; (d) determining the fastest minimum speed of the downstream equipment; (e) monitoring the average production speed of the rewinder; (f) monitoring the actual inventory level of the accumulator; (g) generating a master speed reference value which: (i) corresponds to the slowest maximum speed of said downstream equipment if the actual inventory level of said accumulator is greater than about the upper target limit for the inventory level of the accumulator; or (ii) corresponds to the fastest minimum speed of the downstream equipment if the actual inventory level of the accumulator is less than about the lower target limit for the inventory level of the accumulator; or (iii) is based on the actual production speed of the rewinder if the actual level of inventory in the accumulator is less than about the upper target limit for the inventory level of the accumulator and greater than about the lower target limit for the inventory level of the accumulator; and finally, (h) controlling the production speed of the downstream equipment based on the master speed reference value. The downstream equipment typically comprises one or more logsaws downstream of the accumulator for cutting rewound logs of tissue or towel into lengths suitable for distribution and one or more wrapping stations for applying packaging to the cut rolls. Preferably, the maximum collective production speed of the wrapping stations is capable of meeting or exceeding the maximum production speed of the rewinder and the maximum collective production speed of the logsaws.

Typically, the converting line comprises a plurality of conveyer legs characterized in that each downstream section thereof operates at a speed faster than or slower than its corresponding upstream section. So also, the converting line is usually provided with at least one conveying diverter having more output legs than input legs and at least one conveying converger having more input legs than output legs. In a preferred embodiment, the converting line has at least one diverter or converger operating in a dynamic mode with infinitely variable release ratios based on the demand of downstream equipment supplied by the diverter or converger.

Most preferably, practice of the invention will involve setting a minimum value for the rewinder speed to provide for web breaks and minor disturbances at the rewinder, as well as providing a preferred target value for the inventory level of said accumulator. In the latter cases, the master speed reference value is preferably based on the actual rewinder speed and a trim value calculated to bias the inventory of the accumulator to the preferred target value for the inventory level of the accumulator. The master speed reference value may correspond to the actual rewinder average speed summed with a trim value calculated to bias the inventory of the accumulator to the preferred target value for the inventory level of the accumulator, if so desired. Generally speaking, master speed reference value is refreshed at time intervals of two minutes or less; typically, at time intervals of 1 minute or less; and preferably at time intervals of 30 seconds or less.

The foregoing method is advantageously practiced in an integrated electronic system which stores, calculates and utilizes the control values as described and claimed below.

BRIEF DESCRIPTION OF DRAWINGS

The invention is described in detail below with reference to the various Figures in which.

DETAILED DESCRIPTION

Figure 1:
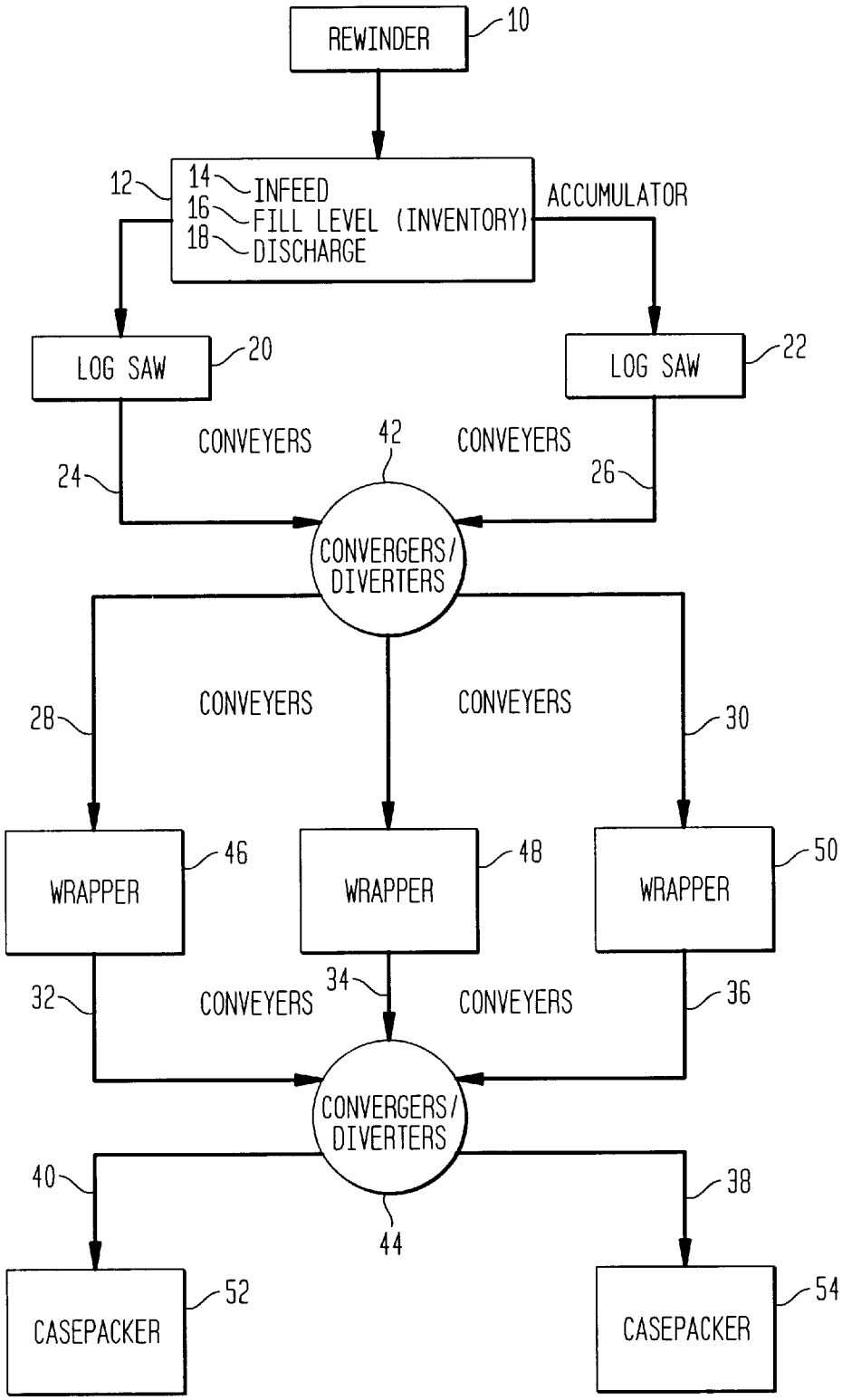
FIG. 1 is a schematic diagram illustrating material flow in converting lines of the class controlled by way of the method and apparatus of the present invention.

The method and apparatus of the present invention is employed on converting lines for making rolls of paper tissue and paper towels. Typically such lines include a rewinder where a parent web roll of several feet in diameter and several feet in length is rewound into "logs" of 5 or 6 inches in diameter or so and several feet in length. During the rewinding process, the web of tissue and towel may be embossed, laminated, or printed if so desired as is known in the art. Likewise, the tail piece of a log may be glued prior or subsequent to transport from the rewinding area to downstream processing. Material flow in a converting line is schematically illustrated in FIG. 1.

A rewinder 10 is employed in order to prepare logs of material from a parent roll as described above. When a log is finished, it is transported from the rewinder to an accumulator 12 which for convenience has indicated an infeed 14, a fill level or inventory 16 and a discharge section 18. The purpose of the accumulator is to inventory logs such that neither upstream nor downstream events will interrupt smooth operation of the converting line.

Accumulator 12 feeds logs, typically of several feet in length and 5 or 6 inches in diameter, to one or more logsaws 20, 22 where the logs are cut into rolls of suitable length for distribution.

Generally speaking, each piece of equipment or station in the line is interconnected by feed sections associated with the upstream equipment or by way of conveyers 24–38 which may have multiple legs and convergers/diverters indicated schematically at 42, 44 which are in place to balance material supply and demand as is known in the art.

Following cutting into rolls by logsaws 20, 22, the rolls are fed by way of conveyers 24, 26 and convergers/diverters 42 to a plurality of wrapping stations 46, 48, 50 where the rolls are individually wrapped and optionally bundled before being conveyed to a plurality of casepackers 52, 54 by way of conveyers 32, 34, 36 and convergers/diverters 44.

As one of skill in the art will appreciate, different combinations of workstations will be employed depending upon the nature of the final product, production speed required and so forth.

A salient feature of the inventive method and apparatus is to increase converting line efficiency with higher product quality and consistency. To this end, it is necessary to control certain machine speeds and balance material flow. This is accomplished by implementing sectionalized speed control, minimizing the number of starts/stops of process equipment, creating uniform product flow and increasing equipment component life. Equipment speeds follow a master speed reference (MSR) based on rewinder speed and inventory levels in the accumulator. MSR is conveniently expressed in cut rolls per minute (cr/min) as a common denominator for the production line. Individual equipment speeds may be trimmed based upon the equipment's condition and product demand, i.e., wrapper backlog eyes. Equipment designed to operate as a start/stop function with no preference to backpressure will not need to have its speed controlled, such as a casepacker. The system optionally provides for manual override on each piece of equipment such that any or all parts of the converting line can be operated at an operator entered line speed.

Figure 2:
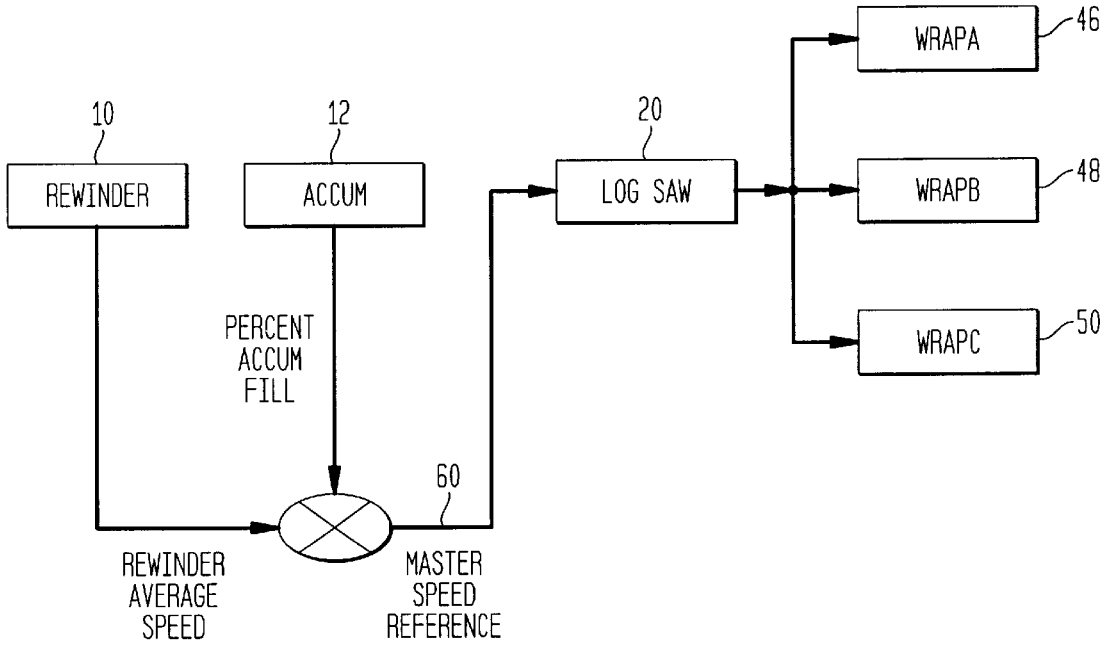
FIG. 2 is a block diagram of the control system of the present invention.

The inventive method and apparatus is further understood by reference to the appended FIG. 2, the following definitions and the examples which follow:

| DEFINITIONS: | |
|---|---|
| rewinder average speed | Two (2) minute running average of actual rewinder speed above the rewinder min speed in fpm |
| rewinder min speed | This is the minimum rewinder speed to be utilized in the rewinder average speed calculations. This minimum speed setpoint in no way affects the operator entered rewinder speed. This value is entered locally and saved with the format settings. |
| accumulator setpoint | The maintained target fill level of the accumulator in percent. This setpoint is entered at the plant floor workstation. |
| accumulator actual | The current fill level of the accumulator in percent. |
| upper max setpoint | The upper accumulator level (acc max) setpoint. This setpoint is entered at the plant floor workstation. |
| lower min setpoint | The lower accumulator level (acc min) setpoint. This setpoint is entered at the plant floor workstation. |
| acc max speed region | This is the region of the accumulator level above the upper max setpoint. |
| acc min speed region | This is the region of the accumulator level below the lower min setpoint. |
| accum mid region | This is the region of the accumulator level between upper max and lower min setpoints. |
| master speed reference (MSR) | Equipment speed reference in rolls per minute. This will be the reference speed for saws, wrappers and conveyers in Remote. |
| log saw max speed | Maximum production speed of the saw to maintain constant quality product. This is not necessarily the guaranteed machine speed. This value is entered locally and saved with the format settings. |
| log saw min speed | Minimum production speed of the saw to maintain a constant quality product. This is not necessarily the guaranteed machine speed. This value is entered locally and saved with the format settings. |
| wrapper max speed | Maximum production speed of the wrapper to maintain a constant quality product. This is not necessarily the guaranteed machine speed. This value entered locally and saved with the format settings. |
| wrapper min speed | Minimum production speed of the wrapper to maintain a constant quality product. This is not necessarily the guaranteed machine speed. This value entered locally and saved with the format settings. |
| wrap total max speed | The total sum of all running wrappers maximum production speed. |
| slowest max speed | This register takes the lowest value between the wrap total max speed and the saw max speed. To be utilized for master speed reference when accumulator is in its max speed region. |
| fastest | This register takes the highest value between the |

-continued

| DEFINITIONS: | |
|---|---|
| min speed | wrap total min speed and the saw min speed. To be utilized for master speed reference (MSR) when accumulator is in its min speed region. |
| wrapper max speed | Maximum production speed of the wrapper to maintain a constant quality product. This is not necessarily the guaranteed machine speed. This value is entered locally and saved with the format settings. |
| bundler max speed | Maximum production speed of the bundler to maintain a constant quality product. This is not necessarily the guaranteed machine speed. This value is entered locally and saved with the format settings. Note: This is the machine speed setpoint. No remote speed control for the bundler. |
| Casepacker max speed | Maximum production speed of the casepacker to maintain a constant quality product. This is not necessarily the guaranteed machine speed. This value is entered locally and saved with the format settings. Note: This is the machine speed setpoint. No remote speed control for the casepacker. |
| conveyer leg | Leg is referenced as a group of conveyer sections between two mechanical components, such as a diverter to a wrapper, or a wrapper to a swing gate. |

FIG. 2 is a simplified control block diagram of a converting line including a rewinder 10, an accumulator 12, a logsaw 20 and wrappers 46, 48 and 50 as discussed in connection with FIG. 1. The log inventory in accumulator 12 is monitored along with the average speed of rewinder 10 in order to generate a Master Speed Reference (MSR) signal which is coupled as shown at 60 for controlling downstream equipment; as further discussed below.

Rewinder

Rewinder 10 receives its speed reference from the entered operator input. Since the main goal of the rewinder is to produce logs, it will not have its speed trimmed based on downstream line conditions like other equipment. The master speed reference will utilize the rewinder average speed which is based upon the average actual speed of the rewinder. The rewinder average speed does have a minimums setpoint, rewinder minimum speed; the intent of this minimum speed is to provide a speed reference during parent roll changes, web breaks, etc.

Accumulator

One of the goals in controlling equipment speeds is to maintain a desired accumulator level. The philosophy is to keep the accumulator level at a setpoint that allows sufficient storage capacity for upstream and downstream disturbances. To accomplish this task, different control schemes related the equipment's master speed reference were developed. First, if the Accumulator Fill Level is in its max speed region, it is imperative to empty the accumulator as fast as possible so as not affect production of the Rewinder. In this region, the master speed reference will not utilize the rewinder average speed but that of the slowest maximum speed of downstream equipment. The master speed reference (MSR) will use this value until the accumulator level equals the setpoint. Once the accumulator level is equal to the desired setpoint as entered in the plant floor workstation, the MSR will use the rewinder average speed and accumulator level to control equipment speeds to keep the accumulator at its setpoint. Equipment will receive an updated master speed reference or MSR on a twenty second interval rate. As long as the accumulator level remains between the upper and lower setpoints, the master speed reference will continue to be calculated. If the accumulator level were to fall below the lower min setpoint, the master speed reference will not use the rewinder average speed but instead the fastest min speed for downstream equipment. The master speed reference will use this value until the accumulator level equals the setpoint. The following three examples will help clarify the different scenarios described above.

ACCUMULATOR % FILL

Given:

1. rewind average speed=800 rolls per minute
2. saw max speed=1200 rolls per minute
3. saw min speed=400 rolls per minute
4. wrapper total max speed=1300 rolls per minute
5. wrapper total min speed=600 rolls per minute

EXAMPLE 1 accumulator actual level=45%–100%

The Speed Control Program looks at what is the maximum possible production speed without starving equipment. In this example this would be the saw at 1200 rolls per minute. 1200 rolls per minute would be the MSR for the saw and the wrappers. The accumulator would start decreasing at a slope rate of −400 rolls per minute (800–1200) until the actual level would equal its setpoint (see Example 3).

Example 2 accumulator actual level=0–15%

The Speed Control Program looks at what is the minimum possible production speed without starving equipment. In this example this would be the wrapper at 600 rolls per minute. 600 rolls per minute would be the MSR for the saw and the wrappers. The accumulator would start increasing at a slope rate of +200 rolls per minute (800–600) until the actual level would equal its setpoint (see Example 3).

EXAMPLE 3 accumulator actual level=15%–45%

Once the Accumulator Level equals the accumulator setpoint the Speed Control Program enters the Auto Mode Region. The purpose of this region is to maintain the actual level to the targeted setpoint. This is also referred to as a Log In/Log Out state in that every log made is converted at the same rate in attempting to keep the accumulator at this level. Downstream equipment is still referencing the master speed reference but instead of looking at the slowest maximum speed, the rewinder average speed is trimmed based upon a calculation in the speed control program that looks at the accumulator level. This trimmed value either adds or subtracts a number of rolls per minute to the rewinder average speed.

Master Speed Reference (rolls per minute)=Rewinder Average Speed+Trimmed Speed

This trimming loop will be active controlling the saws and downstream equipment speeds until the accumulator level exits out of the mid or desired operating region which would result in entering either the Max or Min Speed Regions that would again drive the accumulators fill level back to the targeted setpoint. It needs to be noted that under steady state conditions the accumulator fill level will be maintained near its setpoint without any trimming of the saws or wrapper reference speed.

Figure 3:
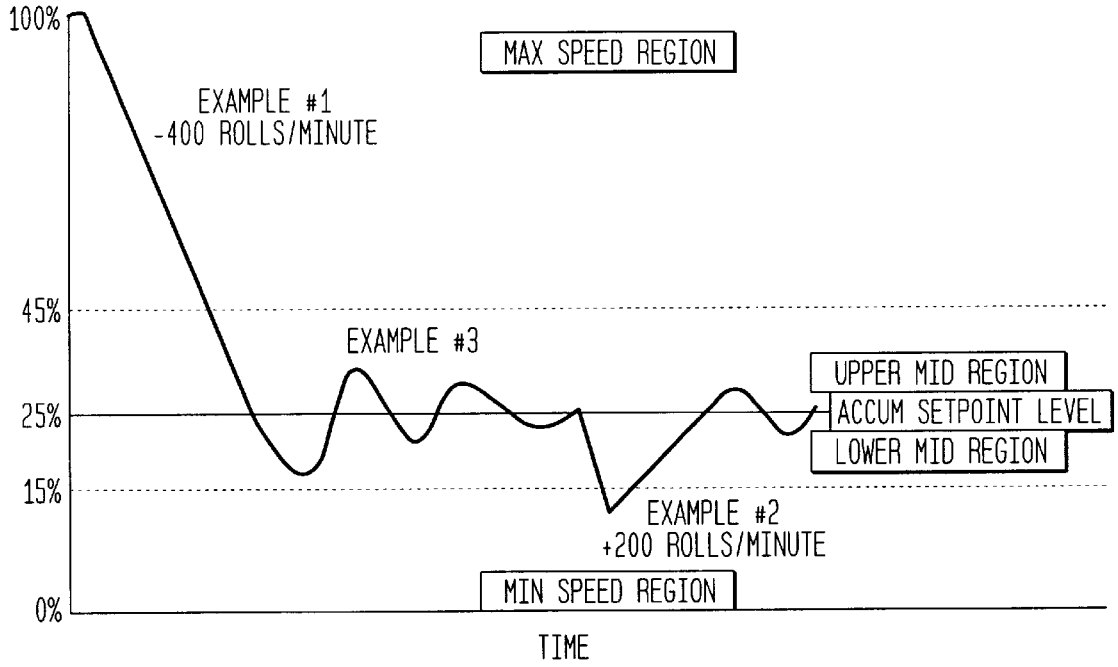
FIG. 3 is a graphical illustration of various operating modes of a converting line and the control response provided by way of the present invention.

The foregoing is illustrated graphically on the appended FIG. 3.

Log Saws

Log saws will receive their speed from the master speed reference every 20 seconds. This will be the machine speed as long as it is between the equipment's maximum and minimum production speed. The maximum and minimum production speed limits are set on the saw's and saved with the format.

Dynamic Diverter

The purpose of a dynamic diverter is to maintain an even distribution of product (backlog) to the infeed of each wrapper. This is necessary because downstream equipment may be operating at different speeds. The diverter will determine its product distribution scheme for each wrapper based upon the wrapper max speeds. The ratio of the two wrappers will determine the amount of product to be distributed to one wrapper versus the other. See example below.

ps Diverter Ratio Example

Given:

wrapper A max production speed limit=360 rolls/min wrapper B max production speed limit=240 rolls/min Calc: 360/240−1.5:1

Rest: wrapper A would receive 1.5 times more product than wrapper B to accommodate the speed differential between the wrappers.

The dynamic diverter or converger distributes product to downstream equipment based on an infinitely variable release ratio, not fixed proportional ratios as used in prior art static diverters or convergers. The release ratio is calculated based on the demand of the equipment that is supplied by the diverter, typically wrappers. The release ratio ensures that downstream equipment maintains proper backpressure with an even distribution based on product demand as determined.

Wrappers

Wrappers will receive their speed from MSR every 20 seconds, or a different predetermined time interval. This will be the machine speed as long as it is between the equipment's maximum and minimum production speed. The maximum and minimum production speed limits are set on the wrapper's and saved with the format. The maximum production speed of each wrapper is used to determine the proportioned amount of speed that it receives from the master speed reference. The example below shows how each wrappers maximum production speed is proportioned to that of the MSR.

Given: Master Speed Reference=800 rolls/min wrapper A max production speed limit=360 rolls/min wrapper B max production speed limit=240 rolls/min wrapper C max production speed limit=280 rolls/min Calc:

wrapper A % speed=360/(360+240+280)=41% wrapper B % speed=240/(360+240+280)=27% wrapper C % speed=280/(360+240+280)=32%

Rest:

wrapper A speed reference=0.41*800=328 rolls/min wrapper B speed reference=0.27*800=216 rolls/min wrapper C speed reference=0.32*800=256 rolls/min Conc: wrapA_sref+wrapB_sref+wrapC_sref=328+216+256=800 rolls/min The wrapper Hi, NORMAL and LO back pressure photoeyes located along the infeed sections of conveyer will trim the wrapper's remote speed by a specific percent as entered in the Speed Control Program. Hi Backlog will result in an increase in Wrapper Speed while Lo Backlog will result in a decrease in Wrapper Speed. The LO back pressure eye will also be an interlock to stop the wrapper due to lack of product while the HI back pressure eye will be used to restart the wrapper.

A wrapper's maximum production speed limit, entered locally, is controlled to match its associated bundler's maximum production speed so as not to out produce the bundler and cause backlog problems. If the bundler configuration is such that the maximum production output cannot keep up with associated wrapper('s), the affected wrapper('s) maximum production speed will be changed to the bundler max speed. By doing this the wrapper('s) can no longer operate faster than the bundler, alleviating potential backlog problems, while potentially resulting in lower rewinder speed. It is imperative that the wrapper max speeds are greater than that of Rewinder and Saw to properly Centerline Product Flow.

Bundlers

Bundlers are designed to operate as a start/stop function, thus there is no need to have their speed remotely controlled. The bundler max speed is its operating speed. The max speed is utilized in the Speed Control Program to insure that upstream equipment cannot out produce the bundler. See Wrapper Section.

Casepacker

Casepackers are designed to operate as a start/stop function, thus there is no need to have its speed remotely controlled. The casepacker max speed is its operating speed. The max speed is utilized in the Speed Control Program to insure that upstream equipment cannot out produce the casepacker.

Conveyer

Figure 4:
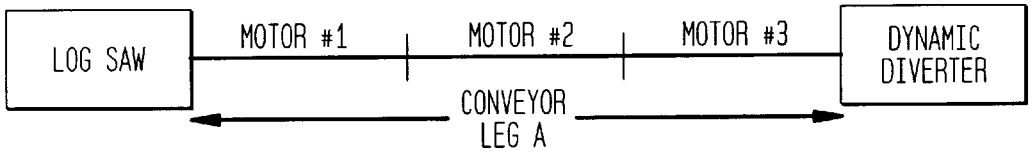
FIG. 4 is a schematic diagram showing various portions of a conveyer leg between a logsaw and a diverter.

Conveyor is a means of transporting product from one converting machine to another. Conveyer is broken into various sections as mechanically defined. Each section will contain an AC Motor and AC drive. The drives output frequency will be controlled over a Communications Network. The drive will provide variable acceleration and deceleration setpoints, electronic current overload protection, variable speeds, and electronic draw rates. Electronic draw is the percent speed difference between conveyer sections. Controlling conveyer draw electrically provides infinite ratios. The purpose of creating positive draw between each section of conveyer is to pull a gap in the product and minimize slugging of product. A conveyer leg is a group of motors between two pieces of equipment, such as the saw and a diverter. Each motor of a leg receives the same speed reference, either a preceding conveyer section or an equipment speed, such as a saw reference. Draw for a conveyer motor is the percent speed difference (fpm) between the motor and its associated leg reference speed. This percentage can also be set negative, resulting in a conveyer section that operates slower than its predecessor, but typically the percentage is set to be positive for proper product flow. Normally each product conveyer section is set to operate faster than the one upstream, with all conveyers operating faster than their associated leg speed. See below how draw is calculated for each conveyer motor of a conveyer leg between a log saw as is illustrated schematically in FIG. 4.

Conveyer Draw Ratio

Given:

Leg A Reference=100 fpm

Motor #1 speed=150 fpm

Motor #2 speed=85 fpm

Motor #3 speed=110 fpm

Calculations:

Motor #1 Draw Ratio=150/100=1.50

Motor #2 Draw Ratio=85/100=0.85

Motor #3 Draw Ratio=110/100=1.10

Once the proper roll gap is set between conveyer sections this draw ratio will insure that product will maintain this gap throughout different reference speeds.

The following sections outline how speed control affects the two distinct types of conveyer utilized, Roll and Package Conveyer.

Roll Conveyer

Roll conveyer exits between the saw and packaging equipment. This section conveys individual rolls of product. The conveyer will not include any product accumulation. Roll conveyer will start, stop, ramp up, and ramp down in line speed with their associated equipment. Conveyer speed controls are application dependent based upon the equipment layout, number of conveyer sections, and availability of conveyer accumulation. These design criteria will affect how and where each conveyer section receives its reference speed. It is the preferred design to control the leg of conveyers exiting the saw to the dynamic diverter from the saw. The leg reference speed is based upon the number of rolls exiting, divided by lanes of product, and then converted into feet of traveling product. Each drive will reference the commanded leg speed times its specific draw ratio for its individual speed reference. This fpm value is then passed directly to its associated drive over the Communications Network. The only difference for conveyer legs between the dynamic diverter and packaging equipment is that the legs are typically controlled by its associated packaging equipment. Where conveyer speeds are calculated by converting the packages per minute output of the machine into fpm of product travel for a reference speed for its associated leg of conveyer. Again, each drive will reference the commanded leg speed times it specific draw ratio for its individual speed reference.

Package Conveyer

Package Conveyers exist between the packaging equipment and case conveyer. The only major difference between package to roll conveyer is that package conveyer will include accumulation. Product accumulation is accomplished with one or more photo-eyes mounted for each conveyer section. A conveyer section will pause as after a specific time that the eye is blocked with product. By pausing a conveyer section this will prevent creating excessive back-pressure to downstream equipment while allowing product to slug in accumulation preventing upstream equipment from immediately stopping. The conveyer will automatically restart once the conveyer section in front restarts. Product conveyers will start, stop, ramp up, and ramp down in line speed with their associated packaging equipment. Package conveyers draw will be set and controlled as that of the Roll conveyer.

Figure 5:
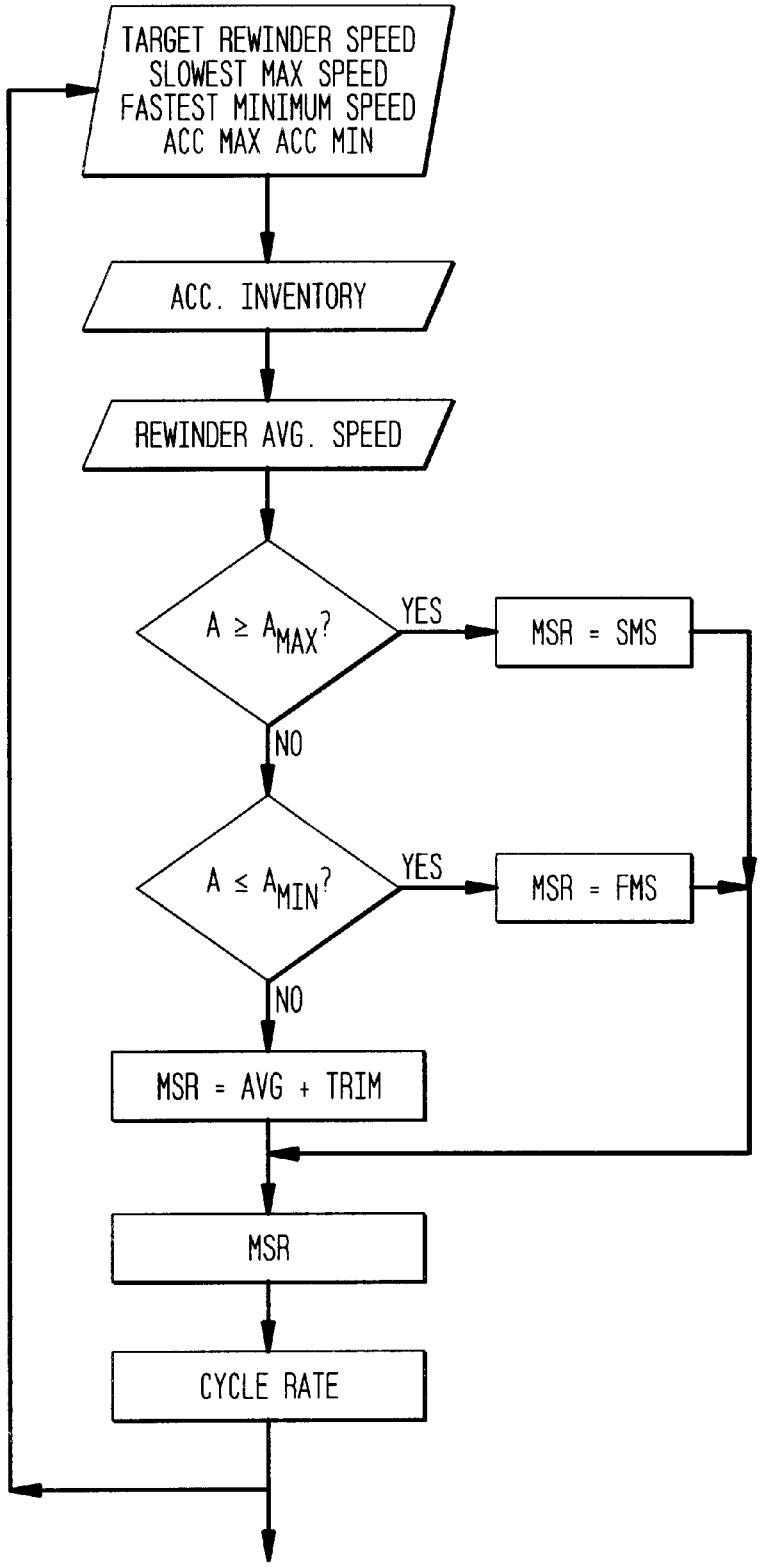
FIG. 5 is a flow chart of a preferred control algorithm.

The primary control algorithm of the converting line is illustrated in the flowchart of FIG. 5. Inputs from the operator (or saved values) include a target rewinder speed, the slowest maximum speed of equipment downstream of the accumulator, the fastest minimum speed of equipment downstream of the accumulator, an upper target inventory limit of the accumulator (acc max) and a lower target inventory limit of the accumulator (acc min). The accumulator actual inventory is monitored, as is the rewinder average speed. In a first decision point the accumulator levels may conveniently be expressed in percent, while speeds can be expressed on a common basis in cut rolls per minute (cr/min).

Given the above information, a first decision point is reached where the actual accumulator inventory level is compared with the upper target inventory limit; if the actual inventory level in the accumulator is greater than or equal to the maximum target level inventory, the MSR is set to the slowest maximum speed (cr/min) of downstream equipment and output to various local controllers in the line as indicated at 60 of FIG. 2.

If the actual inventory level in the accumulator is less than the upper target inventory limit, the algorithm then compares it with the lower target inventory limit of the accumulator. If the actual level is less than or equal to the lower target limit, the MSR (cr/min) is set to the fastest minimum speed of downstream equipment and provided to system controllers as before.

If the actual inventory level in the accumulator is less than the upper target inventory limit and greater than the lower target inventory limit, the MSR is calculated as the rewinder average speed plus (or minus) a trim value. Preferably, the trim value is zero at the target level inventory level in the accumulator. The trim value is the result of the control loop output (−100% to +100%) and variable positive and negative limit in the automode region. The positive and negative limits are based on the difference between the rewinder average speed and the log saws maximum and minimum speeds in rolls per minute and will vary from production line to production line. The calculated limits are then scaled based on the output of the control loop. The net resultant of the scaled limit is referred to as Trim and is added to the Rewinder Average Speed value to determine the MSR. Again the MSR value is output to controllers throughout the converting line.

After a 20 second or other predetermined time delay, the process is repeated as shown in FIG. 5, such that the MSR is updated based on actual inventory levels and rewinder average speed.

The invention has been described and illustrated in connection with particular embodiments but is in no way limited by such description. Modifications to particular embodiments will be readily apparent to those of skill in the art. For example, one could use any suitable common denominator for production speed or provide any suitable signal corresponding to or based upon rewinder speed, limit values and so forth. The spirit and scope of the invention is defined in the appended claims.

What is claimed is:

1. In a production operation for producing rolls of tissue or towel from a parent roll or rolls including a converting line provided with a rewinder, an accumulator and downstream processing equipment, a method of controlling said converting line comprising:

(a) providing an upper target limit for an inventory level of said accumulator;

(b) providing a lower target limit for the inventory level of said accumulator;

(c) determining the slowest maximum speed of said downstream equipment;

(d) determining the fastest minimum speed of said downstream equipment;

(e) monitoring average production speed of said rewinder;

(f) monitoring the actual inventory level of said accumulator;

(g) generating a master speed reference value which:

(i) corresponds to said slowest maximum speed of said downstream equipment if said actual inventory level of said accumulator is greater than about said upper target limit for the inventory level of said accumulator; or (ii) corresponds to said fastest minimum speed of said downstream equipment if said actual inventory level of said accumulator is less than about said lower target limit for the inventory level of said accumulator; or (iii) is based on actual production speed of said rewinder if the actual level of inventory in said accumulator is less than about said upper target limit for the inventory level of said accumulator and greater than about said lower target limit for the inventory level of said accumulator; and (h) controlling the production speed of said downstream equipment based on said master speed reference value.

2. The method according to claim 1, wherein said downstream equipment comprises one or more logsaws downstream of said accumulator for cutting rewound logs of tissue or towel into lengths suitable for distribution and one or more wrapping stations for applying packaging to cut rolls, wherein the maximum collective production speed of said wrapping stations is capable of meeting or exceeding the maximum production speed of said rewinder and the maximum collective production speed of said logsaws.

3. The method according to claim 1, wherein said converting line comprises a plurality of conveyer legs characterized in that each downstream section thereof operates at a speed faster or slower than its corresponding upstream section.

4. The method according to claim 1, wherein said converting line is provided with at least one conveying diverter having more output legs than input legs.

5. The method according to claim 1, wherein said converting line has at least one conveying converger having more input legs than output legs.

6. The method according to claim 1, wherein said converting line has at least one diverter or converger operating in a dynamic mode with infinitely variable release ratios based on demand of downstream equipment supplied by the diverter or converger.

7. The method according to claim 1, further comprising setting a minimum value for the rewinder speed to provide for web breaks and minor disturbances at the rewinder.

8. The method according to claim 1, further comprising providing a preferred target value for the inventory level of said accumulator.

9. The method according to claim 8, wherein the master speed reference value is based on said actual rewinder speed and a trim value calculated to bias the inventory of said accumulator to said preferred target value for the inventory level of said accumulator.

10. The method according to claim 9, wherein the master speed reference value corresponds to the actual rewinder average speed summed with a trim value calculated to bias the inventory of the accumulator to said preferred target value for the inventory level of said accumulator.

11. The method according to claim 1, wherein said master speed reference value is refreshed at time intervals of two minutes or less.

12. The method according to claim 1, wherein said master speed reference value is refreshed at time intervals of 1 minute or less.

13. The method according to claim 1, wherein said master speed reference value is refreshed at time intervals of 30 seconds or less.

14. A control system for controlling a converting line for making rolls of tissue or towel suitable for distribution provided with a rewinder, an accumulator and equipment downstream of said accumulator for cutting logs produced by said rewinder into cut rolls and for packaging said cut rolls, said control system comprising:

(a) means for receiving and storing an upper target limit for an inventory level of said accumulator;

(b) means for receiving and storing a lower target limit for the inventory level of said accumulator;

(c) means for receiving and storing a value corresponding to the slowest maximum speed of said downstream equipment;

(d) means for receiving and storing a value corresponding to the fastest minimum speed of said downstream equipment;

(e) means for determining the actual production speed of said rewinder;

(f) means for determining the actual inventory level of said accumulator;

(g) means for generating a master speed reference value which:

(i) corresponds to said slowest maximum speed of said downstream equipment if said actual inventory level of said accumulator is greater than about said upper target limit for the inventory level of said accumulator; or (ii) corresponds to said fastest minimum speed of said downstream equipment if said actual inventory level of said accumulator is less than the said lower target limit for the inventory level of the accumulator; or (iii) is based on said actual production speed of said rewinder if the actual level of inventory in said accumulator is less than about said upper target limit for the inventory level of said accumulator and greater than about said lower target limit for the inventory level of said accumulator; and (h) means for controlling the production speed of said downstream equipment based on said master speed reference value.

15. The control system according to claim 14, wherein said downstream equipment comprises one or more logsaws downstream of said accumulator for cutting rewound logs of tissue or towel into lengths suitable for distribution and one or more wrapping stations for applying packaging to said cut rolls, wherein the maximum collective production speed of said wrapping stations is capable of exceeding the maximum production speed of said rewinder and the maximum collective production speed of said logsaws.

16. The control system according to claim 14, wherein said converting line comprises a plurality of conveyer legs characterized in that each downstream section thereof operates at a speed faster than its corresponding upstream section.

17. The control system according to claim 14, further comprising means for receiving and storing a minimum value for the rewinder speed to provide for web breaks and minor disturbances at the rewinder.

18. The control system according to claim 14, further comprising a means for receiving and storing a preferred target value for the inventory level of said accumulator.

19. The control system according to claim 18, wherein said means for generating the reference value includes means for calculating a trim value for biasing the level of inventory in said accumulator toward said preferred target value.

20. The control system according to claim 19, wherein said means for generating the master speed reference value includes means for summing said trim value with a value corresponding to the rewinder average speed.

21. The control system according to claim 14, further comprising means for refreshing said master speed reference value at predetermined time intervals.

* * * * *

UNITED STATES PATENT AND TRADEMARK OFFICE

CERTIFICATE OF CORRECTION

PATENT NO. : 6,738,684 B2
DATED : May 18, 2004
INVENTOR(S) : William Buccholz et al.

It is certified that error appears in the above-identified patent and that said Letters Patent is hereby corrected as shown below:

Column 2,
Line 61, change “two” to -- 2 --;

Column 5,
Line 17, change “Casepacker” to -- casepacker --;

Column 7,
Line 2, change “saw’s” to -- saws --;
Line 13, delete “ps” before “Diverter”;
Lines 35 and 38, change “wrapper’s” to -- wrappers --;
Lines 55 and 58, change “Hi” to -- HI --;
Line 59, change “Lo” to -- LO --;

Column 8,
Line 2, change “wrapper(‘s)” in both instances to -- wrapper(s) --;
Line 4, change “wrapper(‘s)” to -- wrapper(s) --;
Line 27, change “drives” to -- drive’s --;

Column 9,
Line 23, change “conveyer. Again,” to -- conveyer, again, --
Line 31, delete “as”;

Column 10,
Line 8, change “limit” to -- limits --; and

Column 11,
Line 39, change “two” to -- 2 --

Signed and Sealed this

Ninth Day of November, 2004

JON W. DUDAS
*Director of the United States Patent and Trademark Office*